US011209145B2

(12) United States Patent
Kanamori

(10) Patent No.: US 11,209,145 B2
(45) Date of Patent: Dec. 28, 2021

(54) OPTICAL UNIT

(71) Applicant: KOITO MANUFACTURING CO., LTD., Tokyo (JP)

(72) Inventor: Akitaka Kanamori, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 16/750,331

(22) Filed: Jan. 23, 2020

(65) Prior Publication Data

US 2020/0158307 A1 May 21, 2020

Related U.S. Application Data

(63) Continuation of application No. PCT/JP2018/026984, filed on Jul. 18, 2018.

(30) Foreign Application Priority Data

Jul. 26, 2017 (JP) ..... JP2017-144668

(51) Int. Cl.
*F21S 8/00* (2006.01)
*F21S 41/675* (2018.01)
*F21S 41/36* (2018.01)

(52) U.S. Cl.
CPC ..... *F21S 41/675* (2018.01); *F21S 41/36* (2018.01)

(58) Field of Classification Search
CPC ..... F21S 41/365; F21S 41/675; F21S 41/36
See application file for complete search history.

(56) References Cited

U.S. PATENT DOCUMENTS

2013/0038736 A1* 2/2013 Yamamura ..... F21S 41/36 348/148
2013/0258689 A1 10/2013 Takahira et al.
(Continued)

FOREIGN PATENT DOCUMENTS

EP 2 988 060 A1 2/2016
GN 103574473 A 2/2014
(Continued)

OTHER PUBLICATIONS

International Preliminary Report on Patentability (Form PCT/IB/373) and the Written Opinion of the International Searching Authority (Form PCT/ISA/237) dated Jan. 28, 2020, in corresponding International Application No. PCT/JP2018/026984. (13 pages).
(Continued)

*Primary Examiner* — Karabi Guharay
(74) *Attorney, Agent, or Firm* — Buchanan Ingersoll & Rooney PC

(57) ABSTRACT

An optical unit includes: a light source; a first reflector that reflects emitted light emitted from the light source, at a first reflection region of which the reflecting direction is periodically changed; and a second reflector that further reflects first reflected light reflected by the first reflector, at a second reflection region of which the reflecting direction is periodically changed. The first reflector is configured such that the second reflection region is scanned with the first reflected light. In the second reflector, the second reflection region is formed such as to reflect the first reflected light to provide second reflected light with which scanning is performed to produce a light distribution pattern.

6 Claims, 9 Drawing Sheets

(56) References Cited

U.S. PATENT DOCUMENTS

| | | | | |
|---|---|---|---|---|
| 2014/0029282 | A1* | 1/2014 | Ravier | F21S 41/60 362/510 |
| 2015/0137680 | A1 | 5/2015 | Komatsu et al. | |
| 2015/0307018 | A1 | 10/2015 | Shibata et al. | |
| 2016/0161074 | A1 | 6/2016 | Yagi et al. | |
| 2017/0159904 | A1 | 6/2017 | Tamamura | |
| 2017/0282783 | A1 | 10/2017 | Ravier et al. | |
| 2018/0043820 | A1 | 2/2018 | Murakami et al. | |
| 2019/0011539 | A1* | 1/2019 | Matsui | G01S 7/4863 |

FOREIGN PATENT DOCUMENTS

| | | | |
|---|---|---|---|
| GN | 104344308 | A | 2/2015 |
| GN | 105674181 | A | 6/2016 |
| JP | 2014-017094 | A | 1/2014 |
| JP | 2014-029858 | A | 2/2014 |
| JP | 2014-207167 | A | 10/2014 |
| JP | 2015-026628 | A | 2/2015 |
| JP | 2016-132444 | A | 7/2016 |
| WO | 2014/024385 | A1 | 2/2014 |
| WO | 2015/045946 | A1 | 4/2015 |
| WO | 2016/072484 | A1 | 5/2016 |
| WO | 2016/167250 | A1 | 10/2016 |
| WO | 2017/104167 | A1 | 6/2017 |

OTHER PUBLICATIONS

International Search Report (Form PCT/ISA/210) dated Oct. 2, 2018, in corresponding International Application No. PCT/JP2018/026984. (4 pages).

Office Action dated Apr. 6, 2021, by the Chinese Patent Office in corresponding Chinese Patent Application No. 201880040867.6 and English translation of the Office Action. (17 pages).

Extended European Search Report dated Mar. 9, 2021, issued by the European Patent Office in corresponding European Application No. 18837709.7. (7 pages).

* cited by examiner

OPTICAL UNIT

CROSS-REFERENCE TO RELATED APPLICATIONS

This application is based upon and claims the benefit of priority from the prior Japanese Patent Application No. 2017-144668, filed on Jul. 26, 2017 and International Patent Application No. PCT/JP2018/026984, filed on Jul. 18, 2018, the entire content of each of which is incorporated herein by reference.

BACKGROUND OF THE INVENTION

1. Field of the Invention

The present invention relates to an optical unit, and, for example, relates to an optical unit used for a vehicular lamp.

2. Description of the Related Art

In recent years, there has been devised a device that reflects light emitted from a light source frontward of a vehicle to scan a region in front of the vehicle using the reflected light, thereby producing a predetermined light distribution pattern. For example, the device may include a rotating reflector that rotates about a rotational axis in one direction while reflecting light emitted from a light source, and a light source constituted by a light emitting element, in which the rotating reflector includes a reflecting surface to reflect light from the light source while rotating, so that the light thus reflected produces a desired light distribution pattern (see Patent Literature 1).

[Patent Literature 1] Japanese Unexamined Patent Application Publication No. 2015-26628

However, the abovementioned device performs scanning with a light source image of one light emitting element in a horizontal direction, or performs scanning, in a horizontal direction, with light source images extending in a horizontal direction of multiple light emitting elements arranged in a row, so as to produce a light distribution pattern. Accordingly, even if a light emitting element is turned on or off at predetermined timing, variations in the position or size of a non-illuminated region formed in part of the light distribution pattern are largely limited.

Meanwhile, a vehicular lamp provided with multiple light emitting diodes (LEDs) arranged in a matrix has also been devised. However, the position or size of a non-illuminated region provided by such a lamp is also dependent on the number or layout of the LEDs. Accordingly, in order to increase the variations in the position or size of the non-illuminated region, the number of LEDs has to be increased, causing increase in size or cost of the lamp.

SUMMARY OF THE INVENTION

The present invention has been made in view of such a situation, and a purpose thereof is to provide a new optical unit capable of producing more light distribution patterns using a light source with a simple configuration.

To solve the problem above, an optical unit of one embodiment of the present invention includes: a light source; a first reflector that reflects emitted light emitted from the light source, at a first reflection region of which the reflecting direction is periodically changed; and a second reflector that further reflects first reflected light reflected by the first reflector, at a second reflection region of which the reflecting direction is periodically changed. The first reflector is configured such that the second reflection region is scanned with the first reflected light, and, in the second reflector, the second reflection region is formed such as to reflect the first reflected light to provide second reflected light with which scanning is performed to produce a light distribution pattern.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

Figure 1:
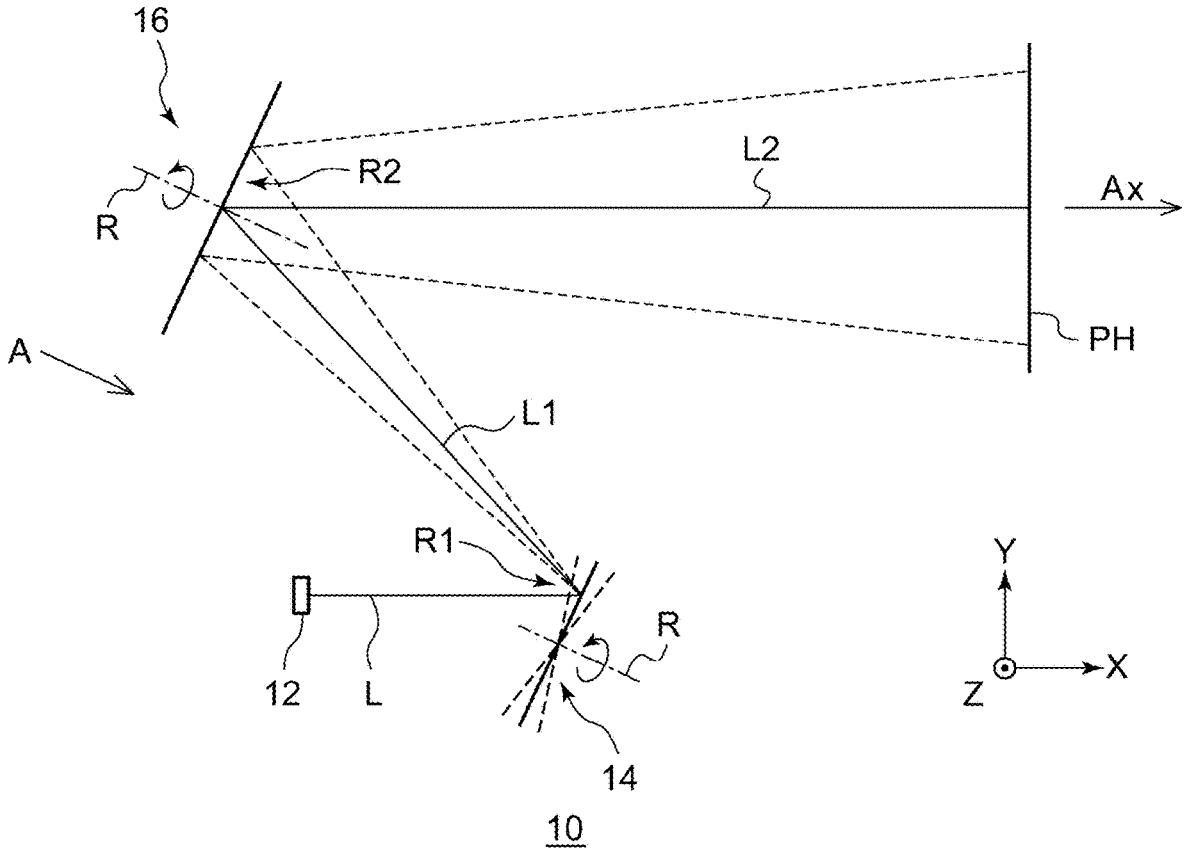
FIG. 1 is a top view that shows a schematic configuration of an optical unit in an embodiment.

In the following, the present invention will be described based on embodiments with reference to the drawings. Like reference characters denote like or corresponding constituting elements, members, and processes in each drawing, and repetitive description will be omitted as appropriate. Embodiments of the invention are provided for purposes of illustration and not limitation, and it should be understood that not all of the features or combinations thereof described in the embodiments are necessarily essential to the invention.

To solve the problem above, an optical unit of one embodiment of the present invention includes: a light source; a first reflector that reflects emitted light emitted from the light source, at a first reflection region of which the reflecting direction is periodically changed; and a second reflector that further reflects first reflected light reflected by the first reflector, at a second reflection region of which the reflecting direction is periodically changed. The first reflector is configured such that the second reflection region is scanned with the first reflected light, and, in the second reflector, the second reflection region is formed such as to reflect the first reflected light to provide second reflected light with which scanning is performed to produce a light distribution pattern.

According to this embodiment, the emitted light from the light source is reflected by the first reflection region of which the reflecting direction is periodically changed and, with the first reflected light thus reflected, the second reflection region is scanned at least linearly. Thereafter, the linear pattern is further reflected by the second reflection region of which the reflecting direction is periodically changed and, with the second reflected light thus reflected, a two-dimensional range is scanned. Accordingly, even if the light source is provided with only one light emitting element, a non-illuminated region can be formed at a predetermined position in a light distribution pattern by controlling turning on and off of the light emitting element, thereby enabling production of more light distribution patterns.

The second reflector may reflect the first reflected light at the second reflection region while rotating about a rotational axis in one direction.

The second reflector may include at least one blade functioning as the second reflection region and provided around the rotational axis.

The first reflector may reflect the emitted light at the first reflection region while rotating about a rotational axis in one direction.

The first reflector may be constituted by a micro electro mechanical system.

The optical unit may further include a control unit that controls the magnitude of a drive current of the light source appropriately for the light distribution pattern.

Optional combinations of the aforementioned constituting elements, and implementation of the present invention in the form of methods, apparatuses, or systems may also be practiced as additional modes of the present invention. According to the present invention, more light distribution patterns can be produced using a light source with a simple configuration.

First Embodiment

An optical unit in the present embodiment can be used for various vehicular lamps. For example, when the optical unit is mounted on a vehicular headlamp, it can produce high beam light distribution patterns appropriate for various situations in front of the vehicle.

Figure 2:
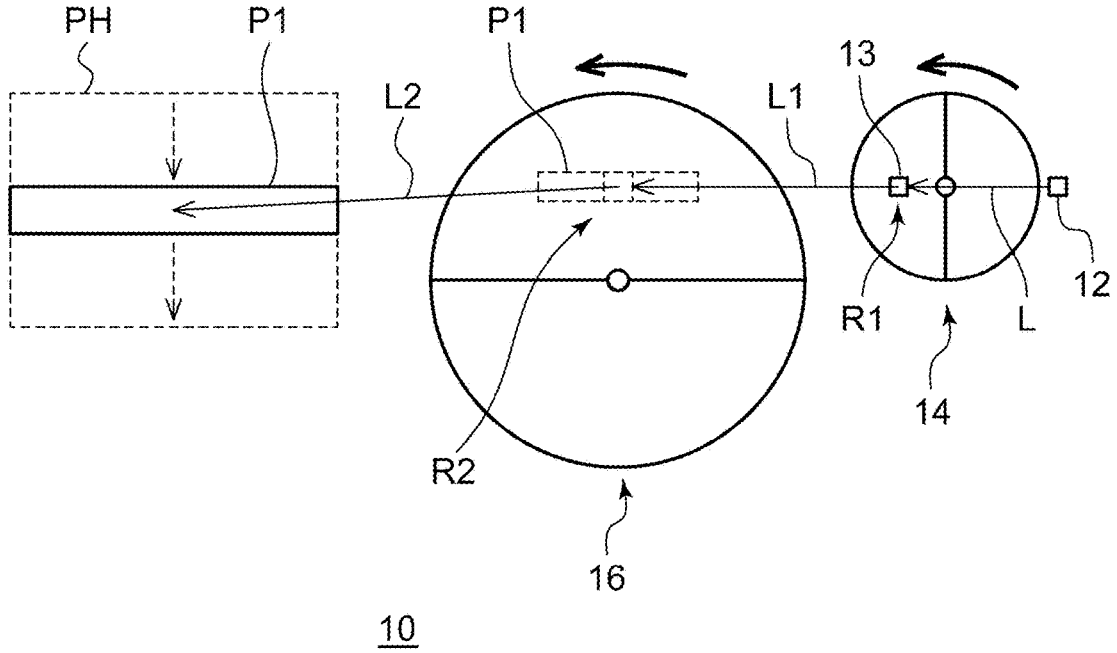
FIG. 2 is a side view that shows a schematic configuration of the optical unit shown in FIG. 1 viewed from an A direction.

FIG. 1 is a top view that shows a schematic configuration of an optical unit in the present embodiment. In FIG. 1, an X direction represents a longitudinal direction of the vehicle, a Y direction represents a width direction of the vehicle, and a Z direction represents a height direction of the vehicle. FIG. 2 is a side view that shows a schematic configuration of the optical unit shown in FIG. 1 viewed from the A direction.

An optical unit 10 includes: a light source 12; a first reflector 14 that reflects emitted light L emitted from the light source 12, at a first reflection region R1 of which the reflecting direction is periodically changed; and a second reflector 16 that further reflects first reflected light L1 reflected by the first reflector 14, at a second reflection region R2 of which the reflecting direction is periodically changed.

The first reflector 14 is configured such that the second reflection region R2 is scanned with the first reflected light L1. In the second reflector 16, the second reflection region R2 is formed such as to reflect the first reflected light L1 to provide second reflected light L2 with which scanning is performed to produce a high beam light distribution pattern PH.

The light source 12 is not particularly limited, as long as it is appropriate for light distribution of the illumination or lamp; however, in terms of downsizing, a semiconductor light emitting element, such as an LED element and a laser diode (an LD) element, may be suitable. At least one light emitting element may be included in the light source 12.

Figure 3A:
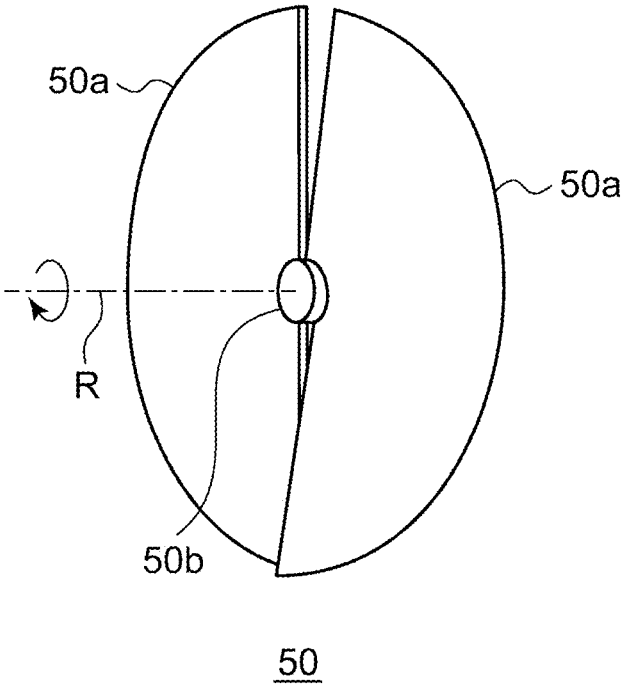
FIG. 3A is a perspective view that shows an example of a rotating reflector used as a first reflector or a second reflector.

There will now be described the shapes of the first reflector 14 and the second reflector 16. FIG. 3A is a perspective view that shows an example of a rotating reflector used as the first reflector 14 or the second reflector 16, and FIG. 3B is a side view of the rotating reflector shown in FIG. 3A.

Figure 3B:
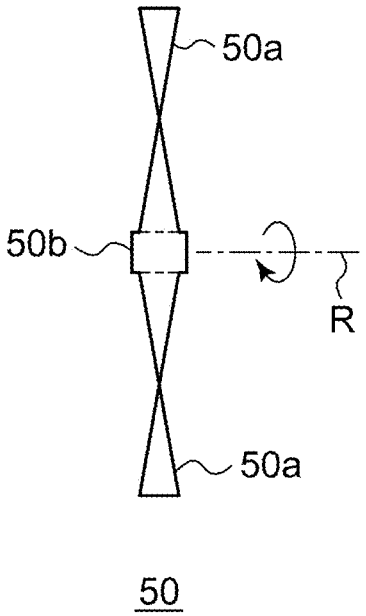
FIG. 3B is a side view of the rotating reflector shown in FIG. 3A.

A rotating reflector 50 shown in FIGS. 3A and 3B rotates about a rotational axis R in one direction by means of a drive source, such as a motor, which is not illustrated. The rotating reflector 50 includes a reflecting surface configured to reflect light emitted from an LED provided in the light source 12 while rotating, thereby producing a desired light distribution pattern.

In the rotating reflector 50, two blades 50*a*, having the same shape and functioning as reflecting surfaces, are provided around a rotating part 50*b* of cylindrical shape. Each of the blades 50*a* has a twisted shape such that the angle between the rotational axis R and the reflecting surface changes according to the position in a circumferential direction when the rotational axis R is regarded as the center. This enables scanning with the first reflected light L1 or the second reflected light L2 as shown in FIG. 1.

Figure 4A:
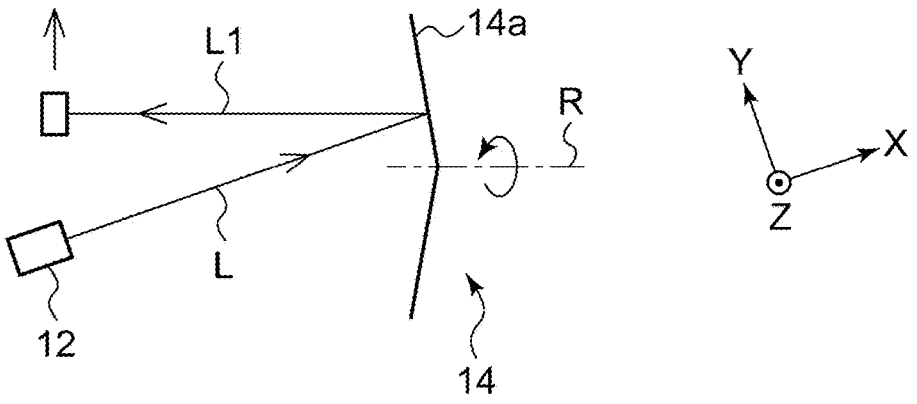
FIGS. 4A-4C are diagrams that each schematically show a state of scanning with first reflected light L1 when the rotating reflector is used as the first reflector.
Figure 4B:
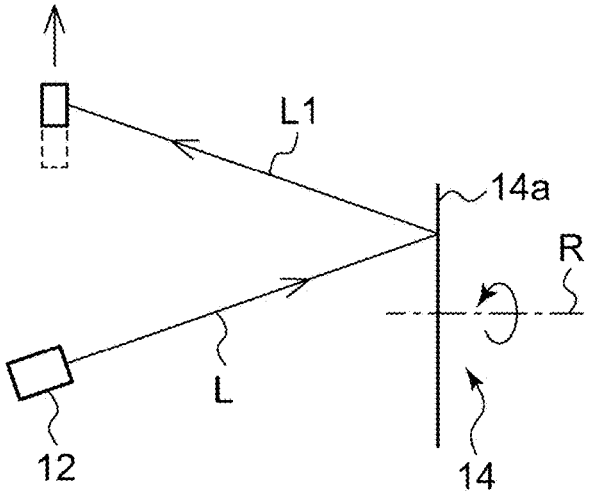
Figure 4C:
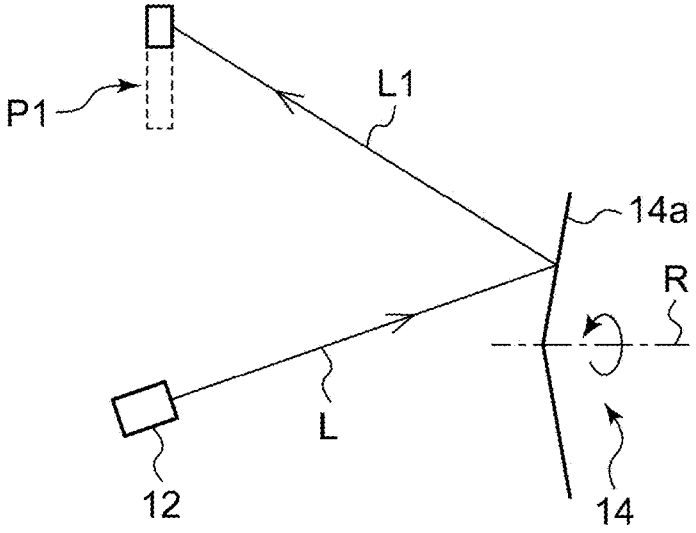

FIGS. 4A-4C are diagrams that each schematically show a state of scanning with the first reflected light L1 when the rotating reflector 50 is used as the first reflector 14. As shown in FIGS. 4A-4C, as the blades 14*a* of the first reflector 14 (corresponding to the blades 50*a* of the rotating reflector 50) rotate, the reflecting surfaces gradually change with respect to the rotational axis R. As a result, scanning with the first reflected light L1 is performed on the second reflection region R2, and a linear pattern P1 is formed.

Figure 5A:
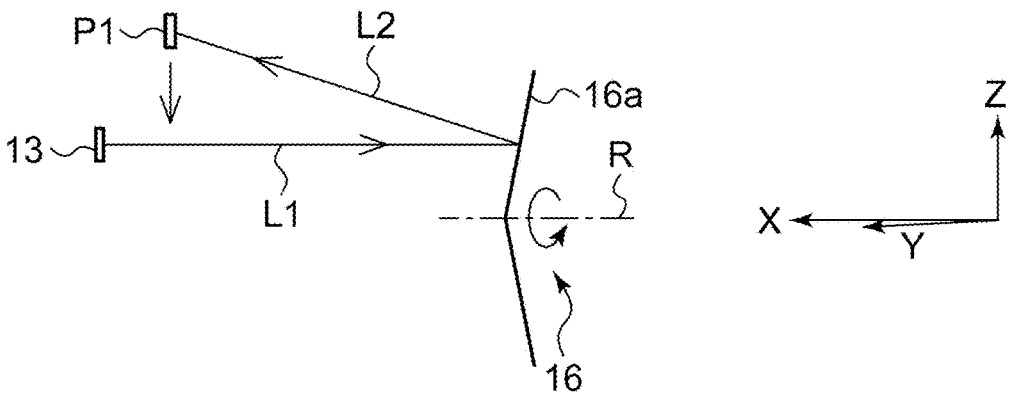
FIGS. 5A-5C are diagrams that each schematically show a state of scanning with second reflected light L2 when the rotating reflector is used as the second reflector.
Figure 5B:
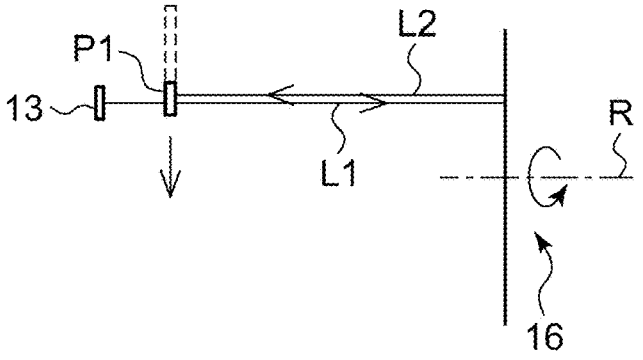
Figure 5C:
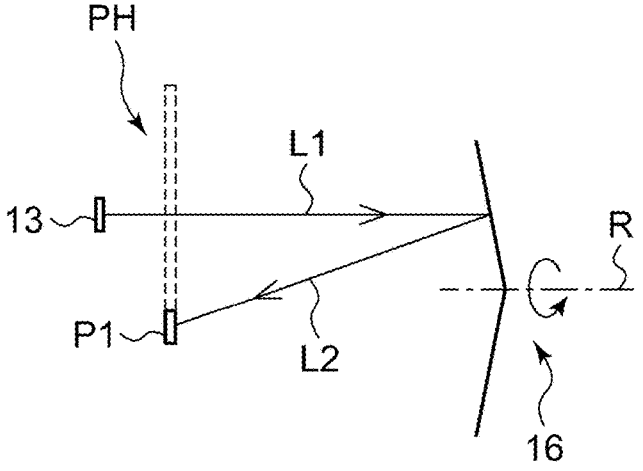

FIGS. 5A-5C are diagrams that each schematically show a state of scanning with the second reflected light L2 when the rotating reflector 50 is used as the second reflector 16. As shown in FIGS. 5A-5C, as the blades 16*a* of the second reflector 16 (corresponding to the blades 50*a* of the rotating reflector 50) rotate, the reflecting surfaces gradually change with respect to the rotational axis R. As a result, the linear pattern P1 formed by scanning with a light source image 13 as the first reflected light L1 performed on the second reflection region R2 is used for scanning in a vertical direction in front of the vehicle.

In the optical unit 10 configured as described above, the emitted light L from the light source 12 is reflected by the first reflection region R1 of which the reflecting direction is periodically changed and, with the first reflected light L1 thus reflected, the second reflection region R2 is scanned at least linearly. Thereafter, the linear pattern P1 is further reflected by the second reflection region R2 of which the reflecting direction is periodically changed and, with the second reflected light L2 thus reflected, a two-dimensional range is scanned, so that the high beam light distribution pattern PH is produced.

Figure 6:
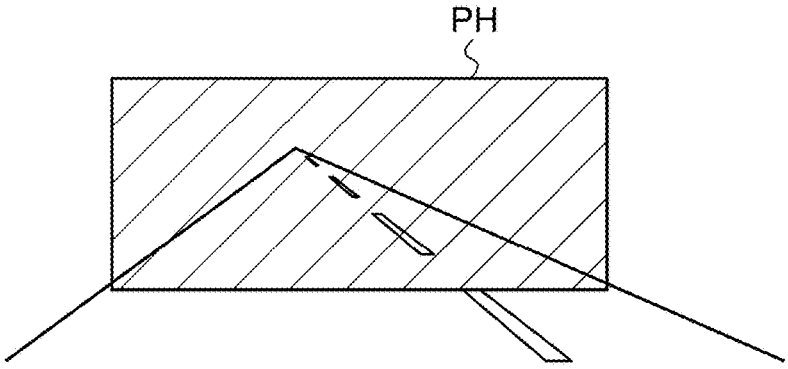
FIG. 6 is a diagram that schematically shows an illumination range of a high beam light distribution pattern in the present embodiment.

FIG. 6 is a diagram that schematically shows an illumination range of a high beam light distribution pattern in the present embodiment. As shown in FIG. 6, with the high beam light distribution pattern PH, a distant region ahead of the subject vehicle or a region in the opposite traffic lane is illuminated.

Figure 7A:
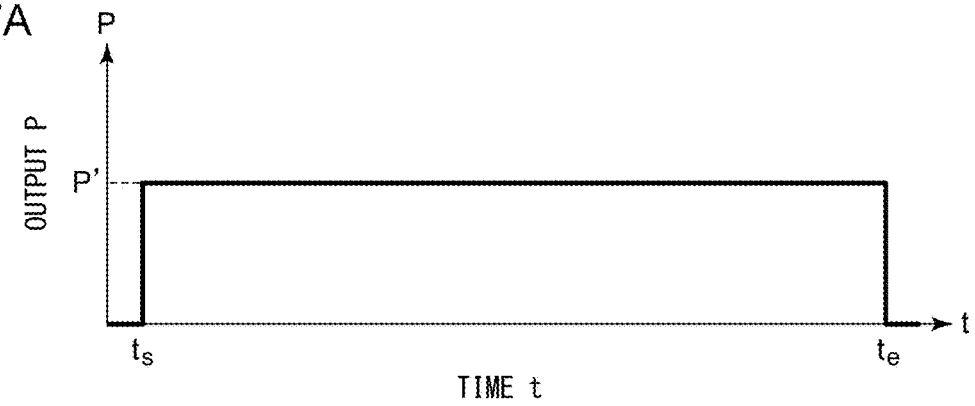
FIG. 7A is a diagram that shows output changes of a light source when a high beam light distribution pattern PH is produced.
Figure 7B:
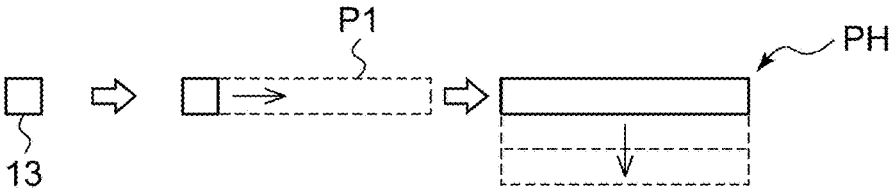
FIG. 7B is a schematic diagram used to describe two-dimensional scanning.

FIG. 7A is a diagram that shows output changes of the light source when the high beam light distribution pattern PH is produced, and FIG. 7B is a schematic diagram used to describe two-dimensional scanning. In the following, the case of controlling turning on and off of a light source provided with one light emitting element will be described; however, the configuration of the light source is not limited thereto, and similar control can be performed on a light source provided with multiple light emitting elements arranged linearly or in a matrix.

A control unit controls driving of the light source 12 and, as shown in FIG. 7A, the control unit controls a drive current of the light source 12 such that output P of the light source 12 increases from zero to P' at a predetermined lighting start time $t_s$, for example. Accordingly, the light source image 13 is produced on the first reflection region R1, as shown in FIG. 7B. While the drive current of the light source 12 is maintained, scanning with the light source image 13 as the first reflected light L1 is performed on the second reflection region R2, so that the linear pattern P1 is formed. Thereafter, while the drive current of the light source 12 is further maintained, scanning with the pattern P1 as the second reflected light L2 is performed on a virtual screen in front of the vehicle, so that the high beam light distribution pattern PH of rectangular shape is produced (time $t=t_e$).

Thereafter, the turning on and off of the light source 12 is repetitively performed at similar timing, so that the high beam light distribution pattern PH is periodically produced. Accordingly, by persistence of vision, the driver feels that a wider range of an area in front of the vehicle is always bright.

Therefore, even the light source 12 provided with only one light emitting element can produce a light distribution pattern for illuminating a significantly wider range compared to the size of the light source image of the light source 12.

Figure 8:
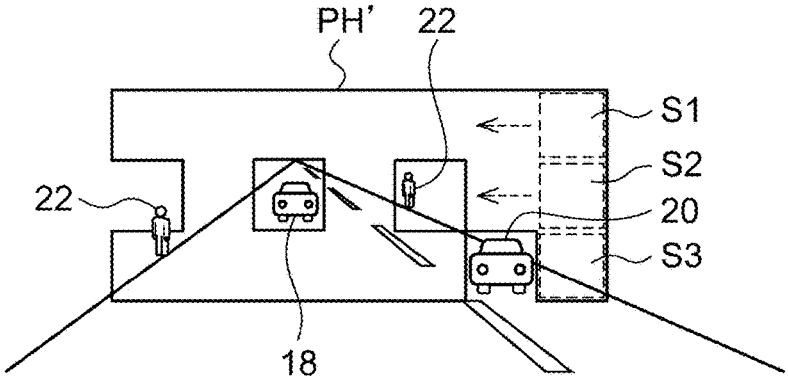
FIG. 8 is a diagram that schematically shows an illumination range of a partial high beam light distribution pattern in the present embodiment.

Meanwhile, depending on the situation in front of the vehicle, there may be a case where the high beam light distribution pattern PH is not appropriate. FIG. 8 is a diagram that schematically shows an illumination range of a partial high beam light distribution pattern in the present embodiment. In the situation shown in FIG. 8, high beam light distribution patterns may provide glare to a preceding vehicle 18 traveling ahead on the traveling lane, an oncoming vehicle 20 traveling on the opposite traffic lane, or a pedestrian 22 walking on the road shoulder or sidewalk. Accordingly, a partial high beam light distribution pattern PH' as shown in FIG. 8 is provided in which a partial region of the high beam light distribution pattern PH is not illuminated.

Figure 9:
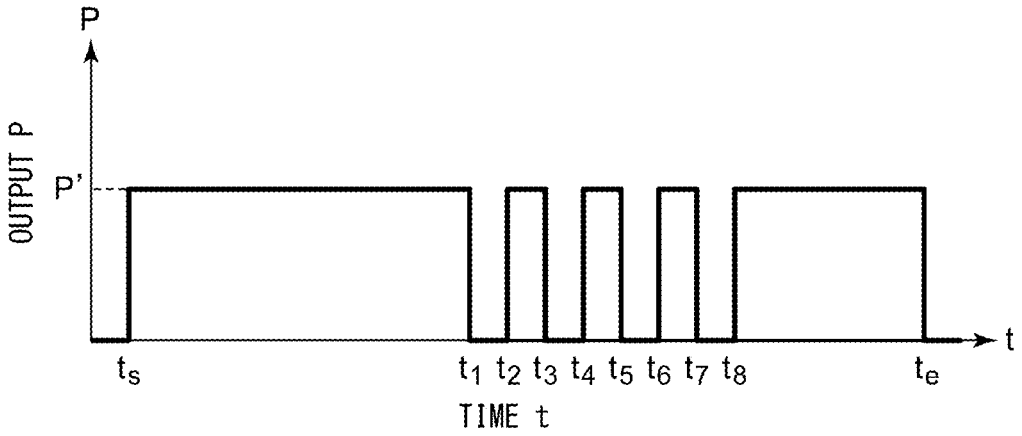
FIG. 9 is a diagram that shows output changes of the light source when a partial high beam light distribution pattern PH' is produced.

FIG. 9 is a diagram that shows output changes of the light source when the partial high beam light distribution pattern PH' is produced. The control unit can control the illumination range in front of the vehicle, based on external information acquired from a camera or a sensor, for example. More specifically, as shown in FIG. 9, the control unit controls the magnitude of the drive current of the light source 12 such that the output P of the light source 12 increases from zero to P' at a predetermined lighting start time $t_s$. Accordingly, in the partial high beam light distribution pattern PH' shown in FIG. 8, scanning with the light source image 13 is performed from a region S1 at the upper right corner toward the left to reach the upper left corner, then performed from a region S2 at the right end in the middle row toward the left to reach the left end in the middle row, and further performed from a region S3 at the lower right corner toward the left to reach the lower left corner.

For each of the time between $t_1$ and $t_2$, the time between $t_3$ and $t_4$, the time between $t_5$ and $t_6$, and the time between $t_7$ and $t_8$, the output P of the light source 12 is set to zero. This produces the partial high beam light distribution pattern PH' in which a range corresponding to each of the preceding vehicle 18, oncoming vehicle 20, and pedestrian 22 is not illuminated. The control unit also controls, besides on and off states of the output, the magnitude of the output P so as to adjust the brightness within the illumination range.

In this way, with the optical unit 10 of the present embodiment, even if the light source 12 is provided with only one light emitting element, a non-illuminated region can be formed at a predetermined position in a light distribution pattern by controlling turning on and off of the light emitting element, thereby enabling production of more light distribution patterns. In other words, without a light source with multiple light emitting elements arranged in a matrix, a non-illuminated region can be formed at a predetermined position in a light distribution pattern.

Since the second reflection region R2 of the second reflector 16 reflects the linear pattern P1 formed by scanning with the light source image 13 of rectangular or circular shape, the second reflection region R2 may preferably be broader than the first reflection region R1 of the first reflector 14. Accordingly, the radius of a blade 16*a* of the second reflector 16 may preferably be larger than the radius of a blade 14*a* of the first reflector 14.

Also, in the optical unit 10 of the present embodiment, multiple times of scanning with the light source image 13 is required while a region corresponding to the high beam light distribution pattern PH is scanned once with the pattern P1. Accordingly, in the optical unit 10 of the present embodiment, the rotational speed of the first reflector 14 is higher than that of the second reflector 16 when the high beam light distribution pattern PH or partial high beam light distribution pattern PH' is produced.

Second Embodiment

The first embodiment describes the case where the rotating reflector 50 shown in FIG. 3 is used as the first reflector 14. Alternatively, other configurations may be employed as long as the linear pattern P1 can be formed on the second reflection region R2 of the second reflector 16. For example, a micro electro mechanical systems (MEMS) mirror may be used.

Figure 10A:
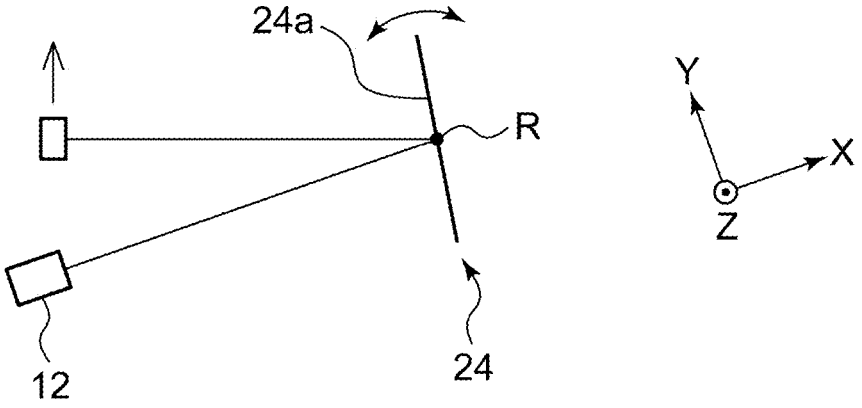
FIGS. 10A-10C are diagrams that each schematically show a state of scanning with the first reflected light L1 when a MEMS mirror is used as a first reflector.
Figure 10B:
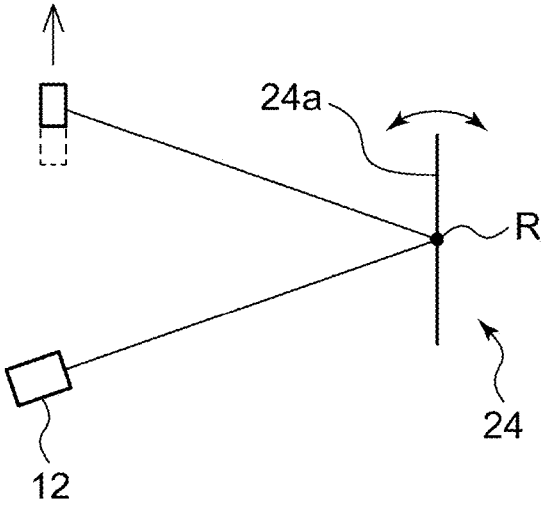
Figure 10C:
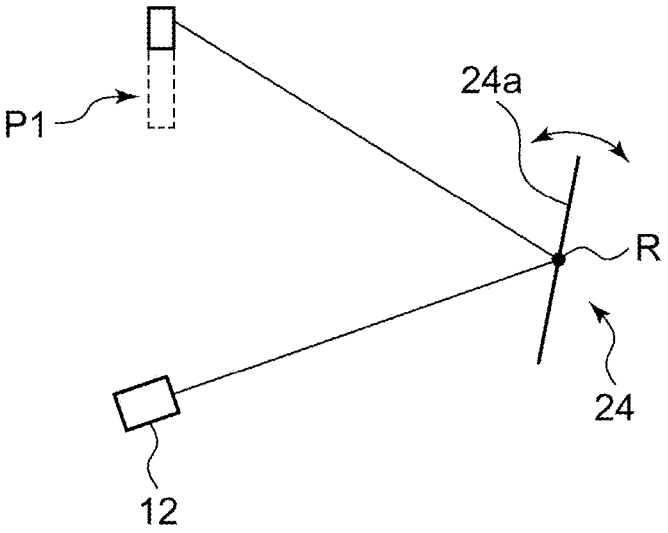

FIGS. 10A-10C are diagrams that each schematically show a state of scanning with the first reflected light L1 when a MEMS mirror is used as a first reflector 24. As shown in FIGS. 10A-10C, as the reflecting surfaces 24*a* of the first reflector 24 rotate about the rotational axis R extending in a Z direction, the reflecting surfaces 24*a* gradually change with respect to the rotational axis R. As a result, scanning with the first reflected light L1 is performed on the second reflection region R2, and the linear pattern P1 is formed. Since the operations thereafter are the same as those in the first embodiment, the description therefor will be omitted.

Thus, using a MEMS mirror as the first reflector 24 enables downsizing of the rotating reflector, compared to the rotating reflector 50 shown in FIG. 3. Also, the MEMS mirror can be driven with a relatively high frequency and enables not only the resonance with constant amplitude but also a temporary change of the amplitude, so that production of light distribution patterns can be controlled in more various ways.

Third Embodiment

In the optical unit of each aforementioned embodiment, a horizontally long pattern is formed by scanning in a horizontal (lateral) direction by means of the first reflector and used for scanning in a vertical (longitudinal) direction by means of the second reflector, thereby producing the high beam light distribution pattern PH.

In the optical unit of the third embodiment, on the other hand, a vertically long pattern is formed by scanning in a vertical (longitudinal) direction by means of the first reflector and used for scanning in a horizontal (lateral) direction by means of the second reflector, thereby producing the high beam light distribution pattern PH.

Figure 11:
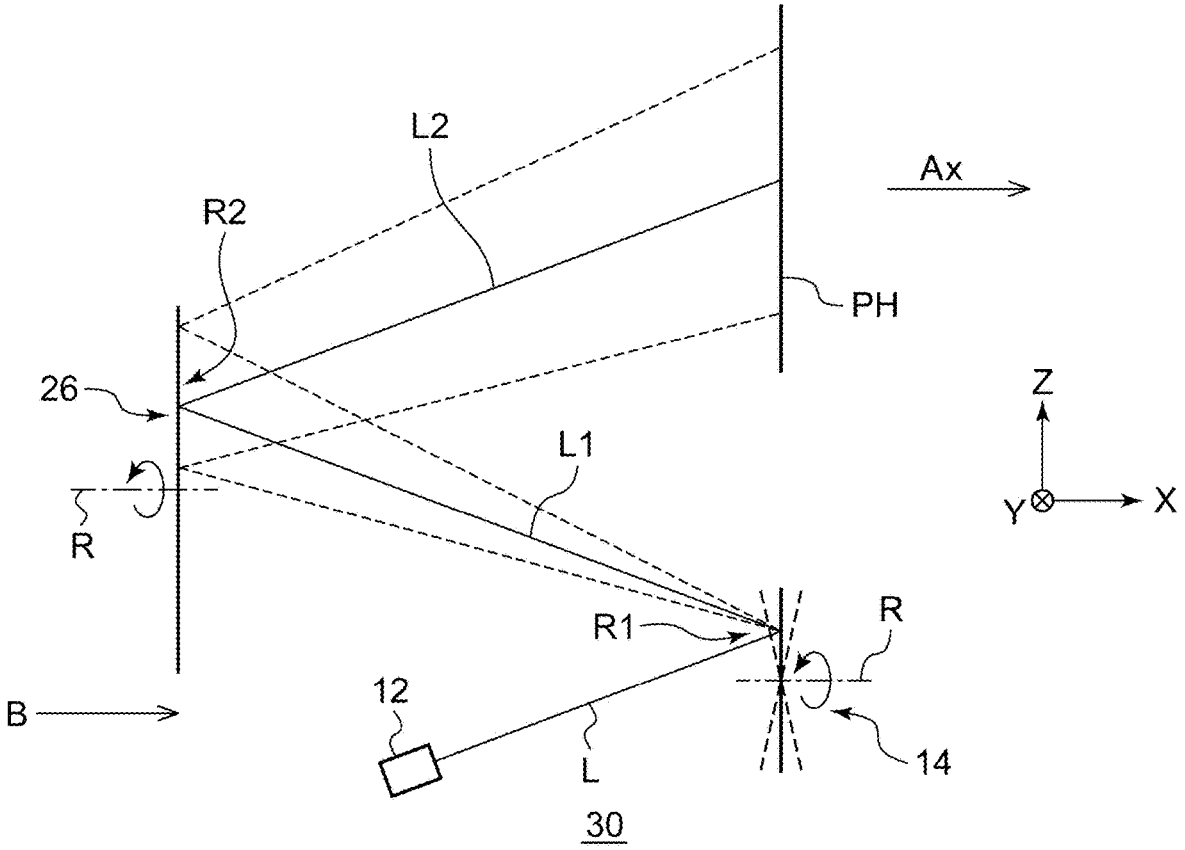
FIG. 11 is a top view that shows a schematic configuration of an optical unit in a third embodiment.
Figure 12:
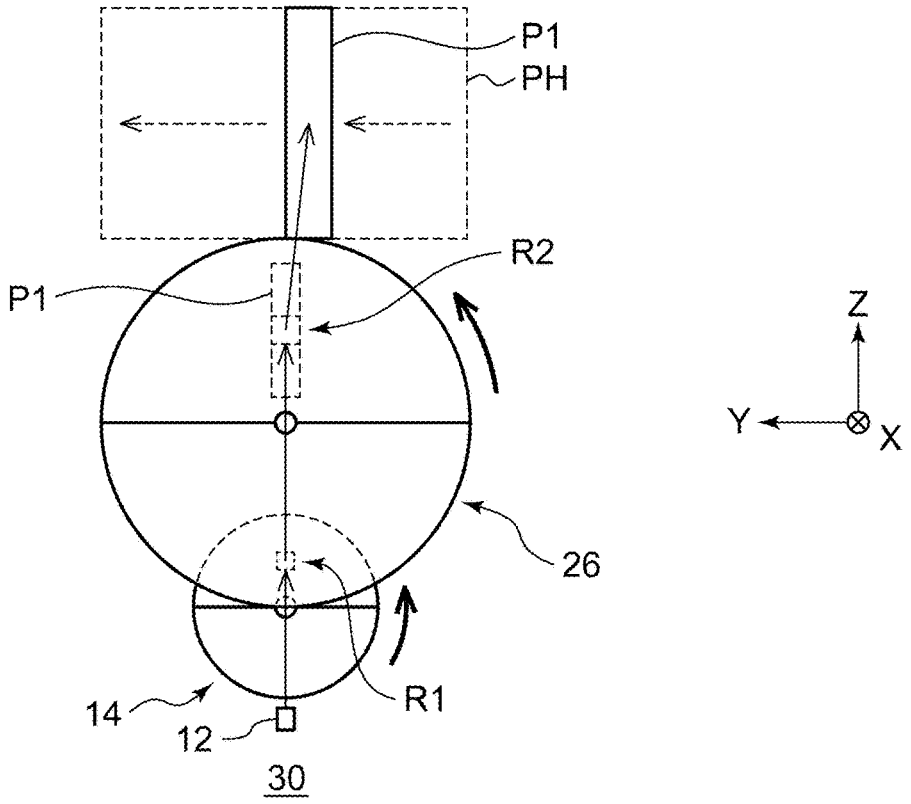
FIG. 12 is a side view that shows a schematic configuration of the optical unit shown in FIG. 11 viewed from a B direction.

FIG. 11 is a top view that shows a schematic configuration of the optical unit in the third embodiment. In FIG. 11, an X direction represents a longitudinal direction of the vehicle, a Y direction represents a width direction of the vehicle, and a Z direction represents a height direction of the vehicle. FIG. 12 is a side view that shows a schematic configuration of the optical unit shown in FIG. 11 viewed from the B direction.

An optical unit 30 includes: a light source 12; a first reflector 14 that reflects emitted light L emitted from the light source 12, at a first reflection region R1 of which the reflecting direction is periodically changed; and a second reflector 26 that further reflects first reflected light L1 reflected by the first reflector 14, at a second reflection region R2 of which the reflecting direction is periodically changed.

The first reflector 14 is configured such that the second reflection region R2 is scanned with the first reflected light L1. In the second reflector 26, the second reflection region R2 is formed such as to reflect the first reflected light L1 to provide a second reflected light L2 with which scanning is performed to produce a high beam light distribution pattern PH.

Figure 13A:
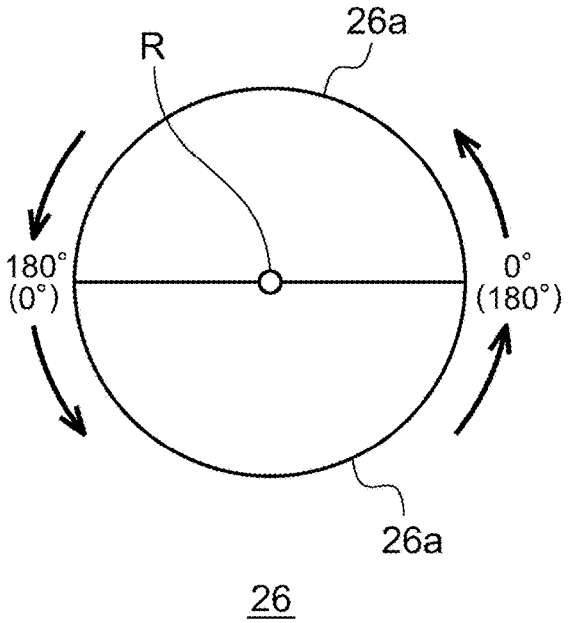
FIG. 13A is a schematic diagram used to describe the shape of the second reflector in the third embodiment.
Figure 13B:
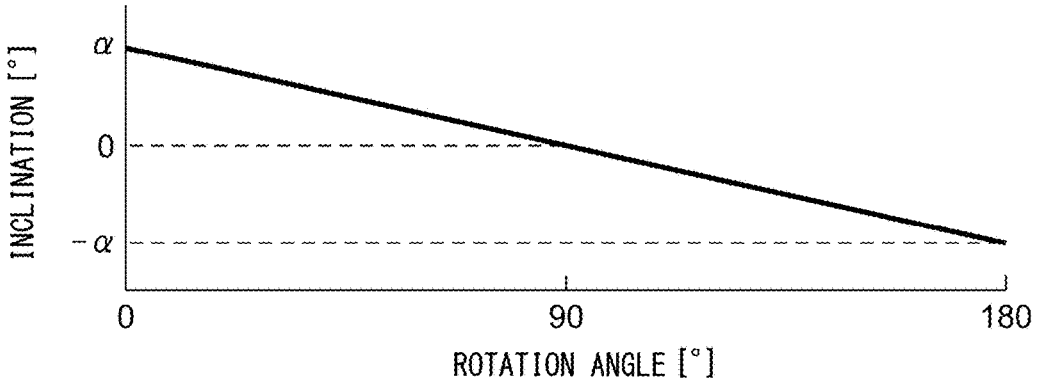
FIG. 13B is a diagram used to describe the specific shape of the second reflector.

The second reflector 26 is different from the second reflector 16 of the first embodiment in the shape of the reflecting surfaces of blades 26*a*. FIG. 13A is a schematic diagram used to describe the shape of the second reflector 26 in the third embodiment, and FIG. 13B is a diagram used to describe the specific shape of the second reflector 26.

The second reflector 26 is configured such that, when the rotation angle of the boundary between the two blades 26*a* is defined as zero degrees, the angle between the normal line of the reflecting surface at the position and the rotational axis R is a degrees (see FIG. 13B), and the pattern P1 is provided to the right end of the high beam light distribution pattern shown in FIG. 12. Also, the second reflector 26 is configured such that, when the rotation angle is 90 degrees, the angle between the normal line of the reflecting surface at the position and the rotational axis R is zero degrees (see FIG. 13B), and the pattern P1 is provided to the middle of the high beam light distribution pattern shown in FIG. 12. Further, the second reflector 26 is configured such that, when the rotation angle is 180 degrees, the angle between the normal line of the reflecting surface at the position and the rotational axis R is $-\alpha$ degrees (see FIG. 13B), and the pattern P1 is provided to the left end of the high beam light distribution pattern shown in FIG. 12.

Also with the optical unit 30 configured as described above, effects similar to those provided by the optical unit 10 in the first embodiment can be obtained.

Fourth Embodiment

Each aforementioned embodiment describes the case where the light source is provided with one light emitting element; however, there may be a case where the light source needs to be provided with multiple light emitting elements or where multiple light sources need to be provided. It may be the case where the output of one light emitting element is insufficient, where the illumination range needs to be broadened, or where the drive frequency (rotational speed) of each reflector is insufficient, for example.

When the output of one light emitting element is insufficient and when the drive frequency (rotational speed) of each reflector is kept unchanged, the high beam light distribution patterns become darker overall. Also, when the drive frequency (rotational speed) of each reflector is low, a space where scanning with the light source image is not performed may be made in part of the illumination range.

Accordingly, each light source in the present embodiment is provided with multiple light emitting elements. For example, the light source may be provided with light emitting elements arranged in an m×n matrix (m and n are natural numbers, and $m \neq 1$ or $n \neq 1$). This can provide a situation where the upper half region of a high beam light distribution pattern is produced using light emitted from a first light emitting element, and the lower half region of the high beam light distribution pattern is produced using light emitted from a second light emitting element, for example. As a result, even when the output of one light emitting element is insufficient or the illumination range needs to be broadened, a light distribution pattern with desired characteristics can be produced.

The present invention has been described with reference to each aforementioned embodiment. However, the present invention is not limited thereto and also includes a form resulting from appropriate combination or replacement of the configurations in each embodiment. It is also to be understood that appropriate changes of the combination or the order of processes in each embodiment or various modifications, including design modifications, may be made based on the knowledge of those skilled in the art and that such changes and modifications also fall within the scope of the present invention.

For example, the light source in each aforementioned embodiment may preferably emit visible light appropriate for light distribution of the illumination or lamp, but may also be a laser light source for light detection and ranging (LiDAR), for example. Also, the optical unit may be provided with an optical receiver for receiving scattered light resulting from irradiation of pulsed laser light emitted from the LiDAR light source. The laser light source as used herein emits electromagnetic waves with relatively short wavelengths, such as ultraviolet rays, visible light rays, and near infrared rays. Accordingly, conditions around the vehicle (whether or not a pedestrian or another vehicle is present, the position of such a pedestrian or another vehicle, the road shape, and the position of a building, for example) can be accurately comprehended, enabling appropriate light distribution control based on the conditions around the vehicle.

The invention claimed is:

1. An optical unit, comprising:

a light source;

a first reflector that reflects emitted light emitted from the light source, at a first reflection region of which the reflecting direction is periodically changed; and a second reflector that further reflects first reflected light reflected by the first reflector, at a second reflection region of which the reflecting direction is periodically changed, wherein:

the first reflector is configured such that the second reflection region is scanned with the first reflected light; and, in the second reflector, the second reflection region is formed such as to reflect the first reflected light to provide second reflected light with which scanning is performed to produce a light distribution pattern, wherein the first reflector reflects the emitted light at the first reflection region while rotating about a first rotational axis in only one direction and comprises at least one first blade functioning as the first reflection region and provided around the first rotational axis, wherein the second reflector reflects the first reflected light at the second reflection region while rotating about a second rotational axis in only one direction and comprises at least one second blade functioning as the second reflection region and provided around the second rotational axis, wherein the radius of the second blade is larger than the radius of the first blade.

2. The optical unit of claim 1, further comprising a control unit that controls the magnitude of a drive current of the light source appropriately for the light distribution pattern.

3. The optical unit of claim 1, wherein the second blade has a shape formed such that the angle between the second rotational axis and the reflecting surface changes according to the position in a circumferential direction when the second rotational axis is regarded as the center.

4. The optical unit of claim 1, wherein the rotational speed of the first reflector is higher than the rotational speed of the second reflector.

5. The optical unit of claim 1, wherein:

the first reflector produces a linear pattern by scanning the second reflection region with the first reflected light in a first direction; and the second reflector produces the light distribution pattern by performing scanning with the linear pattern as the second reflected light in a second direction that intersects the first direction.

6. An optical unit, comprising:

a light source;

a first reflector that reflects emitted light emitted from the light source, at a first reflection region of which the reflecting direction is periodically changed; and a second reflector that further reflects first reflected light reflected by the first reflector, at a second reflection region of which the reflecting direction is periodically changed, wherein:

the first reflector is configured such that the second reflection region is scanned with the first reflected light; and, in the second reflector, the second reflection region is formed such as to reflect the first reflected light to provide second reflected light with which scanning is performed to produce a light distribution pattern, wherein the first reflector reflects the emitted light at the first reflection region while rotating about a first rotational axis in only one direction and comprises at least one first blade functioning as the first reflection region and provided around the first rotational axis, wherein the second reflector reflects the first reflected light at the second reflection region while rotating about a second rotational axis in only one direction and comprises at least one second blade functioning as the second reflection region and provided around the second rotational axis, wherein the radius of the second blade is larger than the radius of the first blade, and the second reflection region is broader than the first reflection region.

* * * * *